US006845878B2

(12) United States Patent
Hayes et al.

(10) Patent No.: US 6,845,878 B2
(45) **Date of Patent: *Jan. 25, 2005**

(54) CONTAINERS

(75) Inventors: Thomas J. Hayes, McHenry, IL (US); Brian J. Cammarata, Farmington, NY (US); William J. Loiselle, Lindenhurst, IL (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/243,393

(22) Filed: Sep. 13, 2002

(65) Prior Publication Data

US 2003/0052133 A1 Mar. 20, 2003

Related U.S. Application Data

(63) Continuation-in-part of application No. 09/953,516, filed on Sep. 14, 2001, now Pat. No. 6,644,494.

(51) Int. Cl.[7] ..... B65D 21/02; B65D 51/16; B65D 43/16; B65D 41/18

(52) U.S. Cl. ..... 220/839; 220/835; 220/780; 220/366.1; 220/366.7; 206/508; 206/509

(58) Field of Search ..... 220/4.21–4.24, 220/835, 837, 839, 780, 781, 782, 380, 324, 326, 366.1, 367.1, 608, 609; 206/508, 509

(56) References Cited

U.S. PATENT DOCUMENTS

| | | | |
|---|---|---|---|
| 3,253,762 | A | 5/1966 | Gaunt |
| 3,583,623 | A | 6/1971 | Golner |
| 3,613,938 | A | 10/1971 | Westcott |
| 3,907,195 | A | 9/1975 | Struble |
| 3,912,118 | A | 10/1975 | Bird |
| 4,034,907 | A | 7/1977 | Engdahl, Jr. |
| 4,206,845 | A | 6/1980 | Christian |
| 4,264,031 | A | 4/1981 | Goebel |

(List continued on next page.)

FOREIGN PATENT DOCUMENTS

| | | |
|---|---|---|
| DE | 857 860 | 12/1952 |
| GB | 2 160 510 A | 12/1985 |
| GB | 2 200 340 A | 8/1988 |

OTHER PUBLICATIONS

Packaging Corporation Of America, Packaging the World Specification Catalog, 4 pages (Feb. 1992).

PCT International Search Report for International Application No. PCT/US02/29251, filed Sep. 12, 2002; dated Dec. 6, 2002; (4 pages).

Description of MIXIM's Clamshell Container from Sambrailo Packaging (date unknown) 1 page; Sambrailo Packaging—Berry Produce and Flower Packaging Solutions—pp. from website www.sambrailo.com, (printed Apr. 18, 2003) 4 pages; 2 drawing pages (prepared on Apr. 21, 2003).

*Primary Examiner*—Nathan J. Newhouse
(74) *Attorney, Agent, or Firm*—Winston & Strawn LLP

(57) ABSTRACT

According to one embodiment, a container comprises a basket and a lid. The basket has a base, a pair of sidewalls, and a pair of endwalls. The base, pair of sidewalls, and pair of endwalls are integrally connected. The pair of sidewalls and the pair of endwalls integrally extend outwardly to form a first latching portion. The base forms a concave channel, a first concave region, and a second concave region. The concave channel extends along a major axis of the base. The first concave region extends from the concave channel to one of the pair of sidewalls, and the second concave region extends from the concave channel to the other of the pair of sidewalls. At least one of the sidewalls and endwall intersections forms a wall ventilation aperture. The lid is connected to the first latching portion of the base. The lid has a second latching portion corresponding to the first latching portion of the base. The first and second latching portions are adapted to retain the lid and the basket in a closed relationship.

59 Claims, 10 Drawing Sheets

U.S. PATENT DOCUMENTS 4,390,113 A 6/1983 Bird
D276,216 S 11/1984 Michaud
4,664,281 A 5/1987 Falk et al.
4,704,510 A 11/1987 Matsui
4,741,452 A 5/1988 Holzkopf
4,771,934 A 9/1988 Kalmanides
4,844,263 A 7/1989 Hadtke
4,859,822 A 8/1989 Ragusa et al.
4,883,195 A 11/1989 Ott et al.
4,974,738 A 12/1990 Kidd et al.
D315,100 S 3/1991 Sheehan
5,065,889 A 11/1991 Conti
5,069,344 A 12/1991 Dehart
5,076,459 A 12/1991 DeHart
D333,094 S 2/1993 Zutler
D339,744 S 9/1993 Seppala
D343,576 S 1/1994 Krupa
D345,894 S 4/1994 Krupa
D348,608 S 7/1994 Wyslotsky
5,339,973 A 8/1994 Edwards et al.
D354,436 S 1/1995 Krupa
5,395,009 A * 3/1995 Kessler et al. ..... 220/670
5,423,453 A 6/1995 Fritz
D361,035 S 8/1995 Krupa
D361,036 S 8/1995 Krupa
D363,022 S 10/1995 Krupa et al.
5,456,379 A 10/1995 Krupa et al.
D363,879 S 11/1995 Krupa et al.
5,515,993 A 5/1996 McManus
D376,314 S 12/1996 Krupa
D378,192 S 2/1997 Krupa et al.
D379,300 S 5/1997 Krupa et al.
D380,381 S 7/1997 Krupa et al.
D382,795 S 8/1997 Abayhan et al.
D385,784 S 11/1997 Krupa et al.
D393,204 S 4/1998 Goins et al.
5,738,890 A 4/1998 Cadiente et al.
5,833,116 A 11/1998 Guillin
D409,485 S 5/1999 Christy, Jr.
5,947,321 A 9/1999 Vadney
6,007,854 A 12/1999 Cadiente et al.
6,074,676 A 6/2000 Cadiente et al.
6,085,930 A 7/2000 Curtis
6,257,401 B1 7/2001 Mangla et al.
D446,017 S 8/2001 Koefelda
D448,288 S 9/2001 Zettle et al.
6,308,858 B1 10/2001 Koefelda
6,367,651 B2 4/2002 Laib et al.
6,390,357 B1 5/2002 Ogryzlo et al.
D473,137 S 4/2003 Cadiente et al.
6,644,494 B2 * 11/2003 Hayes et al. ..... 220/839
6,666,348 B2 * 12/2003 Fore et al. ..... 220/4.21

* cited by examiner

CONTAINERS

RELATED APPLICATION

This application is a continuation-in-part of U.S. patent application Ser. No. 09/953,516, filed Sep. 14, 2001 now U.S. Pat. No. 6,644,494, which is incorporated by reference in its entirety.

FIELD OF THE INVENTION

This invention relates generally to containers, and more specifically to containers having vents for increasing the circulation therethrough.

BACKGROUND OF THE INVENTION

Oftentimes, fruit is put in a container right after being picked, and the fruit is transported in this container to the retailer for selling. Many containers with fruit are transported long distances before reaching their final destination. During the transit, the fruit may become bruised due to a variety of causes. For example, the fruit may experience jostling, resulting in bouncing against other fruit or walls of the container. Also, the fruit may be smashed into a corner of the container. If bruised fruit is found by a seller, it is discarded as scrap and, therefore, counts as a loss. If the seller does not notice the bruised fruit and it is purchased by a consumer, this can result in customer dissatisfaction.

Another problem associated with transporting certain fruit is spoilage. Some fruits need to be kept cold to retain their freshness during transit and up until being purchased by a customer. To keep the fruit inside the container cool, refrigerated trucks are used that circulate air while the containers are in transit.

Since numerous pieces of fruit are often in one container, however, it is difficult to keep the fruit cool by only circulating air around the container. Containers have been developed that include vents in the bottom and along the sides of the container to increase airflow therethrough. In these containers, air is circulated not only around the outside, but some of the air flows into the container and circulates around the fruit.

These existing containers, however, do not adequately circulate air therethrough. There is still fruit on the inside of the container that may not be kept cool through these circulation efforts. The containers are often stacked on top of each other, and the cool air never reaches the venting apertures in the bottom of some of the containers.

Thus, there is a need for a container that improves the transport of fruit by reducing or inhibiting bruising and/or improving air circulation.

SUMMARY OF THE INVENTION

According to one embodiment, a container comprises a basket and a lid. The basket has a base, a pair of sidewalls, and a pair of endwalls. The base, pair of sidewalls, and pair of endwalls are integrally connected. The pair of sidewalls and the pair of endwalls integrally extend outwardly to form a first latching portion. The base forms a concave channel, a first concave region, and a second concave region. The concave channel extends along a major axis of the base. The first concave region extends from the concave channel to one of the pair of sidewalls, and the second concave region extends from the concave channel to the other of the pair of sidewalls. At least one of the sidewall and endwall intersections forms a wall ventilation aperture. The lid is connected to the first latching portion of the base. The lid has a second latching portion corresponding to the first latching portion of the base. The first and second latching portions are adapted to retain the lid and the basket in a closed relationship.

According to another embodiment, a hinged container, comprises a basket and a lid. The basket has a base, a pair of generally smooth and flat sidewalls, and a pair of generally smooth and flat endwalls. The base, pair of sidewalls, and pair of endwalls are integrally connected. The pair of sidewalls and the pair of endwalls integrally extend outwardly to form a first latching portion. The base forms a concave channel, a first concave region, and a second concave region. The concave channel extends generally parallel to a major axis of the base. The first concave region extends from the concave channel to one of the pair of sidewalls, and the second concave region extends from the concave channel to the other of the pair of sidewalls. The base forms a vertical contact point near each of four corners of the base. Each of the vertical contact points forms a ventilation aperture and is adapted to nestably engage a lid of a second container when the second container is in a stacked relationship with the container. The lid is hingedly connected to the first latching portion. The lid has a second latching portion corresponding to the first latching portion. The first and second latching portions are adapted to retain the lid and the basket in a closed relationship. The first and second latching portions define a first ventilation slot, a second ventilation slot opposite of the first ventilation slot, and a pair of third opposing ventilation slots when the first and second latching portions are in a closed relationship with each other. The lid forms a plurality of ventilation apertures.

According to a further embodiment, a hinged container comprises a basket and a lid. The basket has a base, a pair of generally smooth sidewalls, and a pair of generally smooth endwalls. The base, pair of sidewalls, and pair of endwalls are integrally connected. The pair of sidewalls and the pair of endwalls integrally extend outwardly to form a first latching portion. The base forms a concave channel, a first concave region, and a second concave region. The concave channel extends generally along a major axis of the base. The first concave region extends from the concave channel to one of the pair of sidewalls, and the second concave region extends from the concave channel to the other of the pair of sidewalls. At least one of the sidewall and endwall intersections forms a wall ventilation aperture. The lid is hingedly connected to the first latching portion. The lid has a second latching portion corresponding to the first latching portion. The first and second latching portions are adapted to retain the lid and the basket in a closed relationship. The first and second latching portions define a first ventilation slot, a plurality of ventilation apertures opposite of the first ventilation slot, and a pair of third opposing ventilation slots when the first and second latching portions are in a closed relationship relative to each other. The first ventilation slot and the pair of third ventilation slots are located on a different one of the pair of sidewalls and endwalls.

According to yet another embodiment, a hinged container comprises a basket and a lid. The basket has a base, a pair of sidewalls, and a pair of endwalls. The base, pair of sidewalls, and pair of endwalls are integrally connected. The pair of sidewalls and the pair of endwalls integrally extend outwardly to form a first latching portion. The base forms a cushioning region that is adapted to flex when a force is applied thereto. At least one of the sidewall and endwall intersections forms a wall ventilation aperture. The lid is hingedly connected to the first latching portion. The lid has a second latching portion corresponding to the first latching portion. The first and second latching portions are adapted to retain the lid and the basket in a closed relationship.

According to yet a further embodiment, a hinged container comprises a basket and a lid. The basket has a base, a pair of sidewalls, and a pair of endwalls. The base, pair of sidewalls, and pair of endwalls are integrally connected. The pair of sidewalls and the pair of endwalls integrally extend outwardly to form a first latching portion. At least one of the sidewall and endwall intersections forms a wall ventilation aperture. The lid is hingedly connected to the first latching portion. The lid has a second latching portion corresponding to the first latching portion. The first and second latching portions are adapted to retain the lid and the basket in a closed relationship. The first and second latching portions define a first ventilation slot and a second ventilation slot opposite the first ventilation slot when the first and second latching portions are in a closed relationship with each other. The first and second ventilation slots extend parallel to a major axis of the container.

According to yet a further embodiment, a container comprises a basket and a lid. The basket has a base, a pair of sidewalls, and a pair of endwalls. The base, pair of sidewalls, and pair of endwalls are integrally connected. The pair of sidewalls and the pair of endwalls integrally extend outwardly to form a first latching portion. The base forms a concave channel, a first concave region, and a second concave region. The concave channel extends along a major axis of the base. The first concave region extends from the concave channel to one of the pair of sidewalls, and the second concave region extends from the concave channel to the other of the pair of sidewalls. The lid is connected to the first latching portion of the base. The lid has a second latching portion corresponding to the first latching portion of the base. The first and second latching portions are adapted to retain the lid and the basket in a closed relationship.

BRIEF DESCRIPTION OF THE DRAWINGS

The foregoing and other advantages of the invention will become apparent upon reading the following detailed description and upon reference to the drawings.

Figure 1:
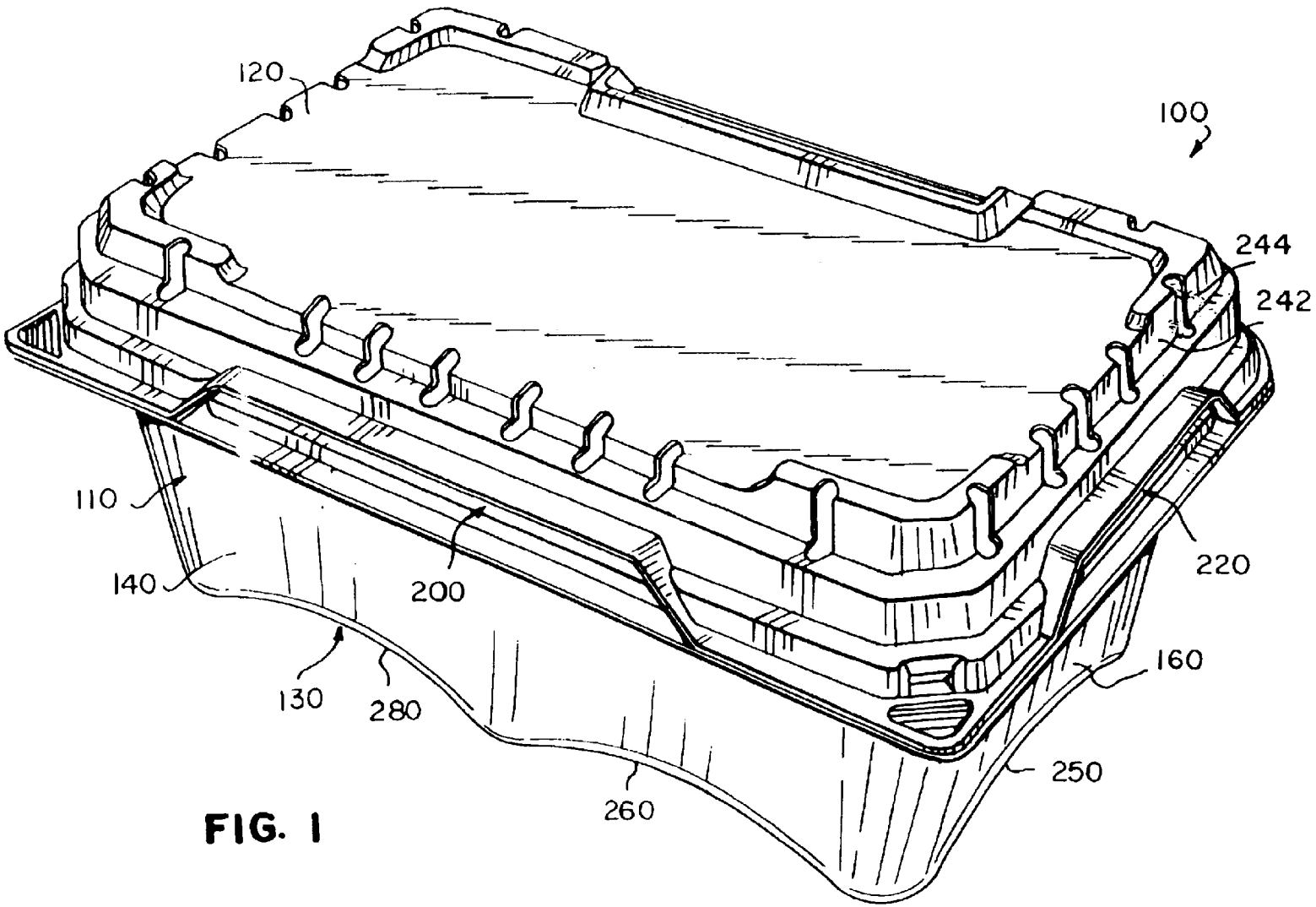
FIG. 1 is a perspective view of a container according to one embodiment.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 2:
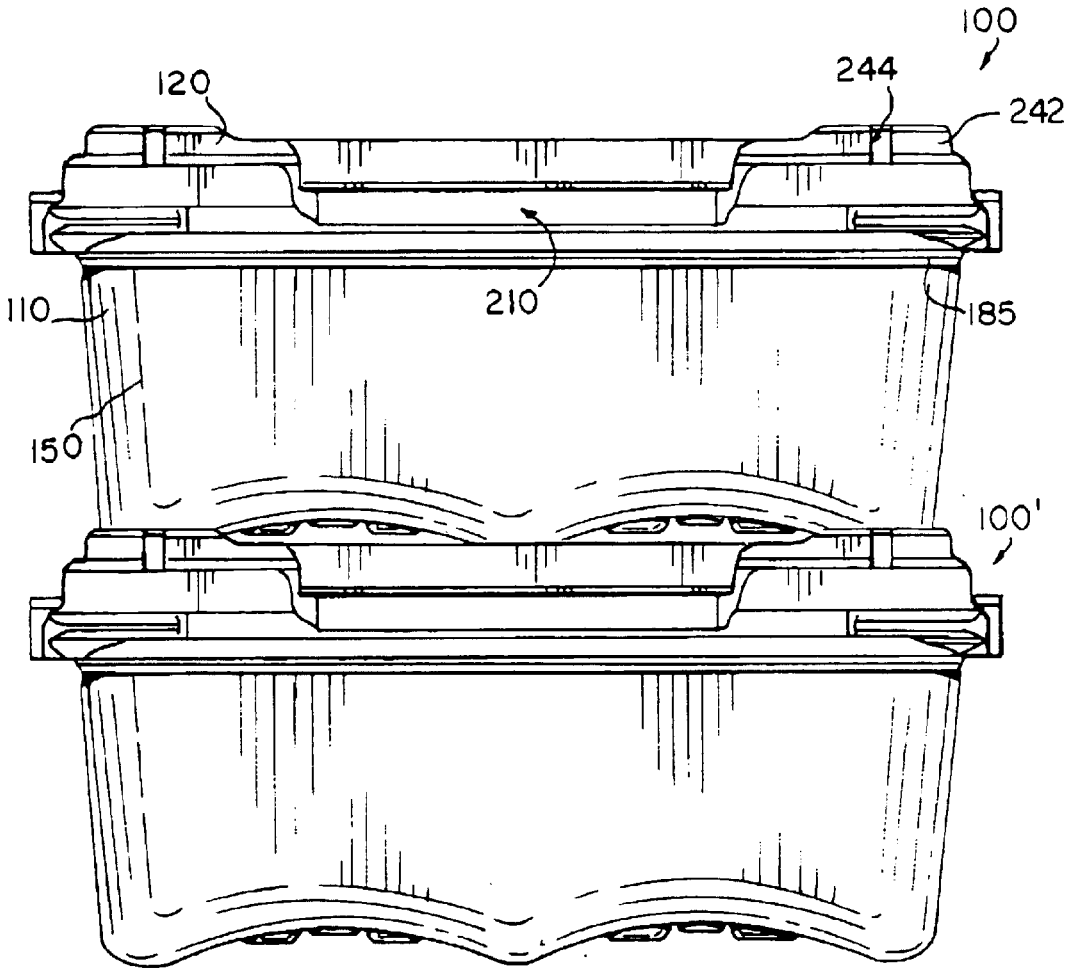
FIG. 2 is a side view of a stacked arrangement of two containers according to one embodiment.
Figure 3:
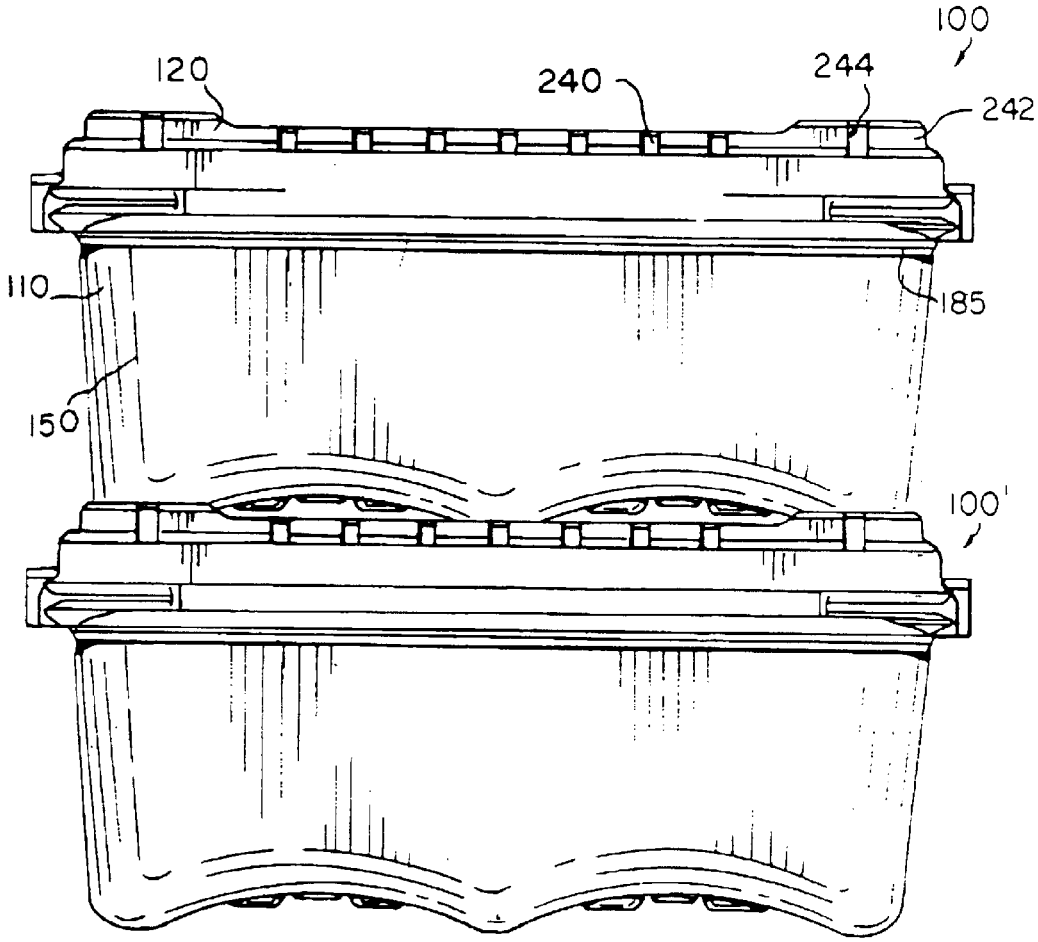
FIG. 3 is a side view of a stacked arrangement of two containers according to another embodiment.

Referring now to FIGS. 1–4, a container 100 according to one embodiment will be described. FIG. 1 is a perspective view of the container 100 according to one embodiment and FIG. 2 is a side view of the container 100 in a stacked relationship with container 100'. FIG. 3 is an alternative embodiment of the container 100 and FIGS. 4*a* and 4*b* illustrate end views of the container 100. The container 100 is adapted to carry materials, such as food products, during transport. For ease of description, the specification will refer to fruit as the item being carried, although the container may be used to transport other food products. Referring to FIGS. 1–4*b*, the container 100 comprises a basket 110 and a lid 120. The basket 110 comprises a base 130 and two opposing sidewalls 140, 150 integrally connected to two opposing endwalls 160, 170. The sidewalls 140, 150 and endwalls 160, 170 extend continuously upwardly from the base 130 and form a first latching portion 180. The endwalls 160, 170 and sidewalls 140, 150 in this embodiment are generally smooth and do not have any ribs. The smoothness of the endwalls 160, 170 and sidewalls 140, 150 provides a cushioning effect for the fruit that is transported in the container 100. This assists in inhibiting or reducing the fruit from becoming bruised because the ribless container 100 does not have any sharp edges. Thus, the smoothness of the sidewalls 140, 150 and endwalls 160, 170 lessens the likelihood of mechanical bruising (bruising of the fruit caused by the container) during transport.

The intersections of respective generally smooth sidewalls 140, 150 and generally smooth endwalls 160, 170 form gently curved corners. The curvature of the corners assists in inhibiting the bruising of the fruit by making it more difficult for fruit to be smashed into the corner and, thus, bruised or damaged. Thus, the curved corners also lessen the likelihood of mechanical bruising of the fruit during transport. It is contemplated that the intersections of the respective sidewalls and endwalls may form at least four curved corners.

The generally smooth sidewalls 140, 150 are also generally flat relative to the inside of the basket 110. Since the sidewalls 140, 150 are generally flat, the "oil canning effect," or buckling of the sidewalls, is eliminated. The endwalls 160, 170 are also generally flat relative to the inside of the basket 110.

Figure 9A:
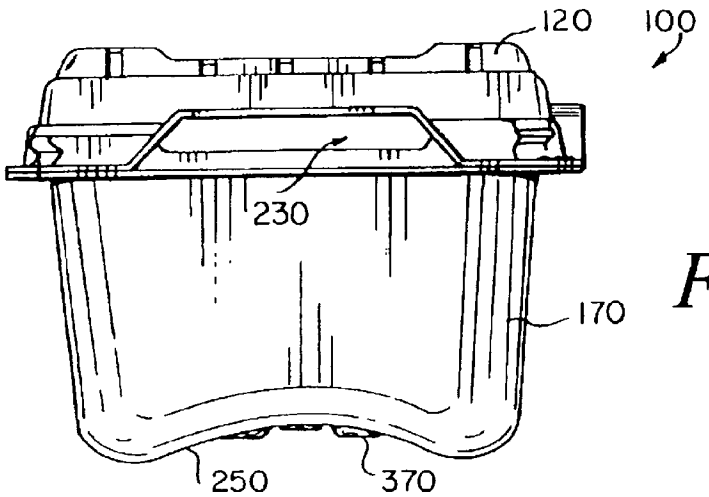
FIG. 9*a* is an end view of a container similar to the container of FIG. 1 with the lid in a closed position.
Figure 9B:
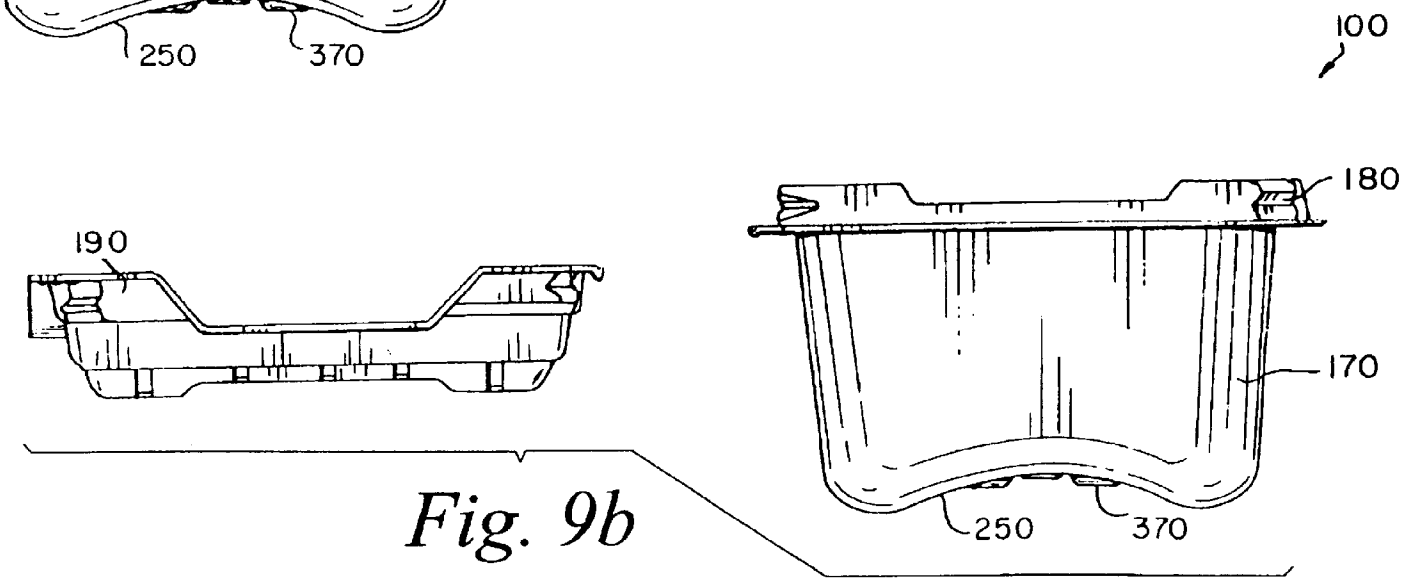
FIG. 9*b* is an end view of a container similar to the container of FIG. 1 with the lid in an open position.

The lid 120 is hingedly connected to the first latching portion 180 via a hinge 185 and includes a second latching portion 190. The first latching portion 180 and the second latching portion 190 are configured to retain the lid 120 and basket 110 in a closed relationship. The first and second latching portions 180, 190 may be configured as is known in the art. For example, the lid and the base may be two separate pieces, as depicted in FIGS. 9*a* and 9*b*. Alternatively, the lid and base may be hingedly connected according to other methods known in the art.

When the basket 110 and lid 120 are retained in a closed position, the first and second latching portions 180, 190 define a first ventilation slot 200 along the sidewall 140. The first ventilation slot 200 allows air (e.g., cool air) to flow into the container 100. While fruit is being transported, it must remain cold to retain its freshness. The first ventilation slot 200 allows cool air to flow into the basket and, thus, cool the fruit.

In one embodiment, the sidewall 140 defines a second ventilation slot 210 (FIG. 2). In the embodiment depicted, the second ventilation slot 210 is cut in a "step" formation, extending from the top of the lid 120 until just above the hinge 185. In other embodiments, the second ventilation slot 210 may be a mirror of the first ventilation slot 200. The first and second ventilation slots 200, 210 are located generally opposite each other, so air may flow into one of the first and second ventilation slots 200, 210, through the container 100 and then out of the other of the first and second ventilation slots 200, 210. The second ventilation slot 210 is constructed to align with the first ventilation slot 200.

Figures 4A, 4B:
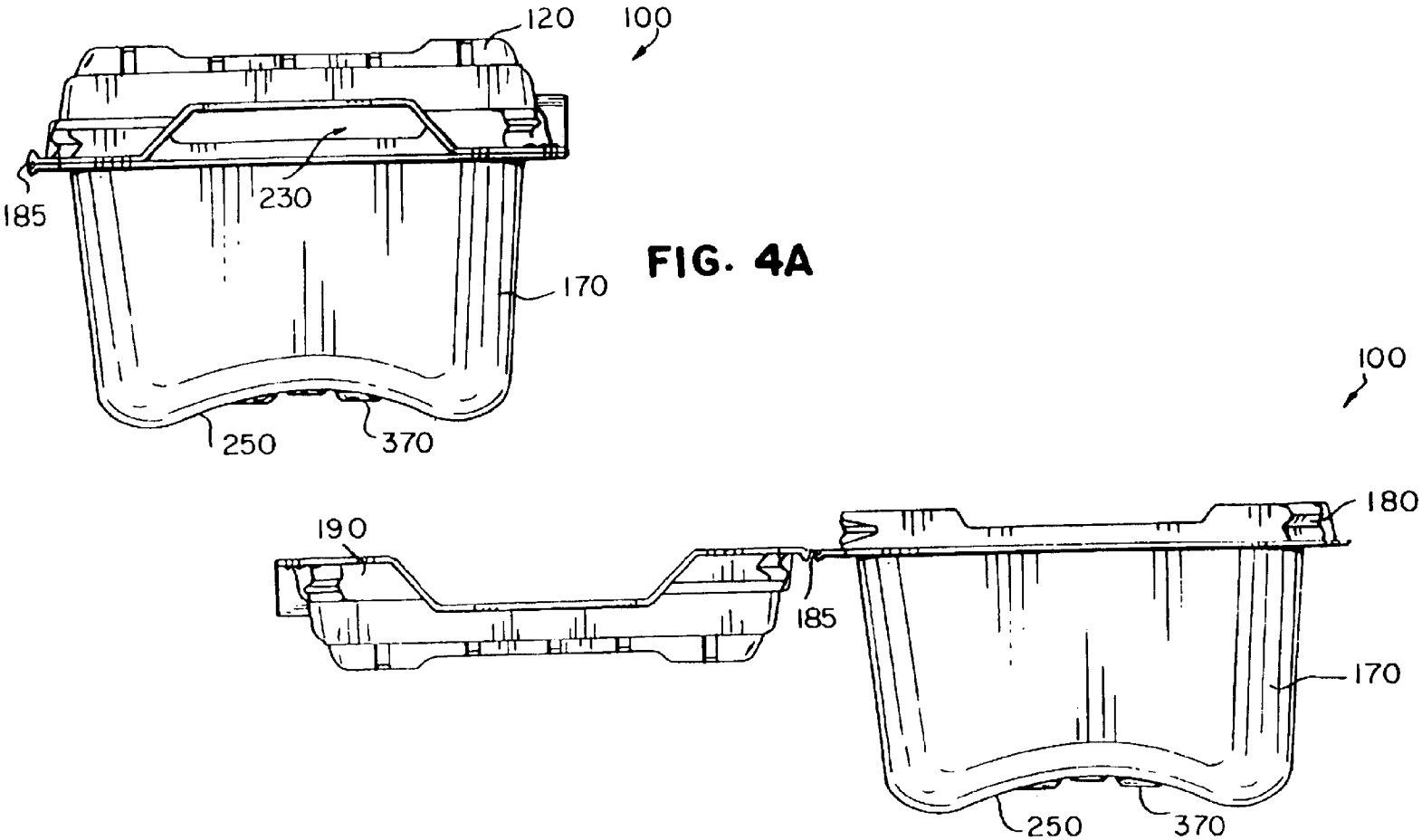
FIG. 4*a* is an end view of the container of FIG. 1 with the lid in a closed position.
FIG. 4*b* is an end view of the container of FIG. 1 with the lid in an open position.

The first and second latching portions 180, 190, when in a closed position, define a third ventilation slot 220 and a fourth ventilation slot 230. The fourth ventilation slot 230 is best shown in FIG. 4A. The third ventilation slot 220 is located adjacent to the endwall 160 of the basket 110, while the fourth ventilation slot 230 is located adjacent to the endwall 170 of the basket 110. The third and fourth ventilation slots 220, 230 allow air to flow through the container 100 in a direction generally perpendicular to the air flowing into the container 100 from the first ventilation slot 200. Thus, the container 100 has increased circulation from the plurality of ventilation slots, which easily cool the fruit and maintain freshness.

In another embodiment, the first and second latching portions 180, 190 do not define a second ventilation slot when closed. Instead, the first latching portion 180 defines a plurality of ventilation apertures 240 (FIG. 3). The plurality of ventilation apertures 240 are in alignment with the first ventilation slot 200, so that air may flow through both the first ventilation slot 200 and the ventilation apertures 240.

The lid 120 also forms a rim 242 that extends at least partially around the edge of the lid. In FIG. 1, the rim 242 extends from the beginning of the second ventilation slot 210 around the rest of the lid 120, ending at the other end of the second ventilation slot 210. The rim 242 forms a plurality of rim ventilation apertures 244 that extend around the rim 242. As shown in FIG. 1, the rim ventilation apertures 244 are located above the first, third and fourth ventilation slots 200, 220, 230. Also, two of the rim ventilation apertures 244 are adjacent to the second ventilation slot 210. In the embodiments where the second ventilation slot 210 is not stepped and mirrors the first ventilation slot 200, the rim ventilation apertures may extend entirely around the rim 242. In some embodiments, the rim ventilation apertures 244 may only be on one side of the lid 120; in other embodiments, the rim 242 may not be included, and the lid 120 may form the ventilation apertures 244. Alternatively, the lid 120 may not have any rim ventilation apertures 244.

Another feature designed to increase the cooling capabilities of the container 100 is a concave channel 250 that is formed in a direction along a major axis of the base 130 (FIG. 1). For example, the concave channel may be formed in a generally parallel or parallel to a major axis of the base 130. It is contemplated that the concave channel may be formed diagonally with respect to the major axis of the base. During transport, the container 100 is stacked with other containers 100' (FIG. 2). When the containers 100, 100' are stacked, it is difficult to circulate the cool air therebetween, which may result in spoilage. The concave channel 250 that is formed along the base 130 allows air to flow under a stacked container 100 or even when the container 100 is set on a flat surface.

Figure 5:
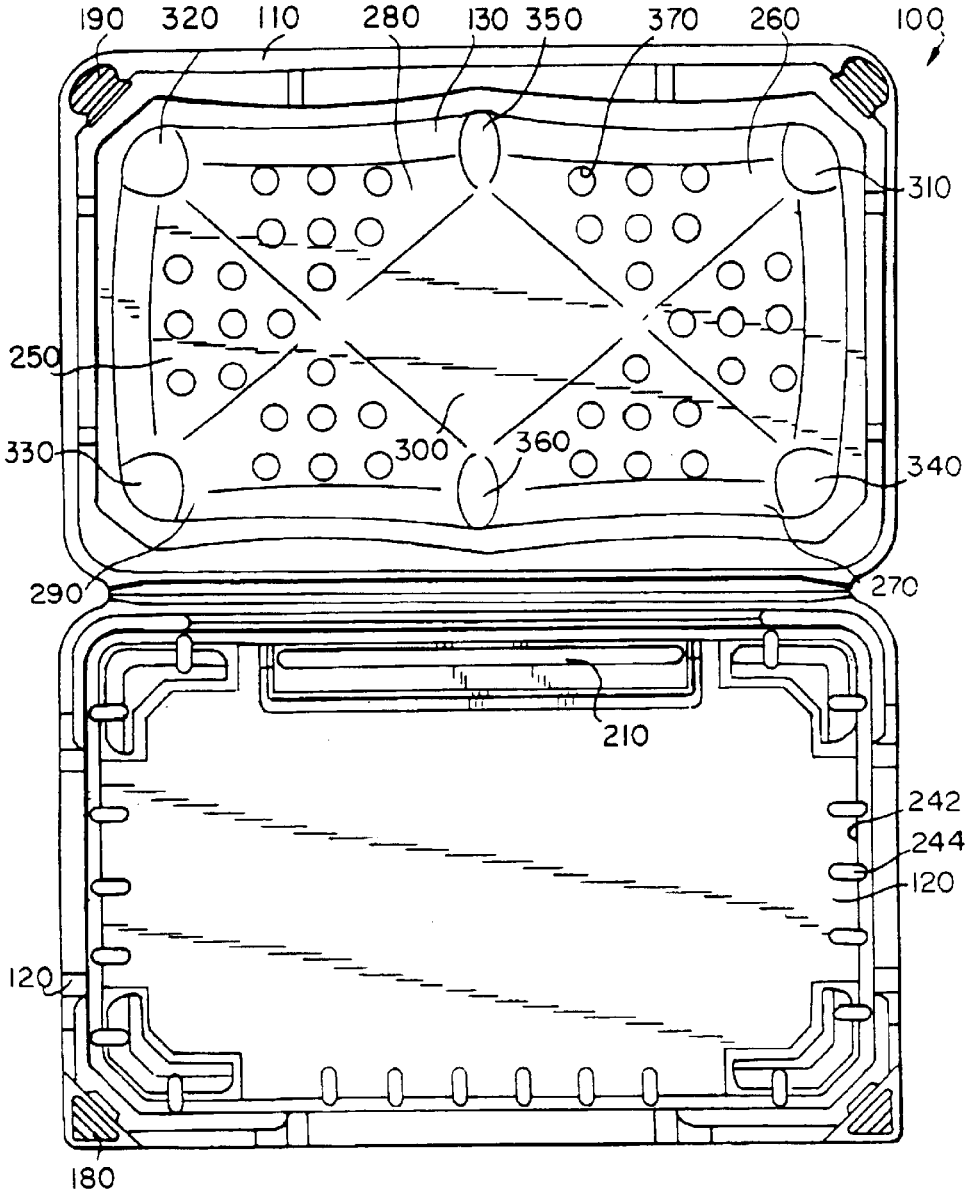
FIG. 5 is a top view of the container of FIG. 1 in an open position.

As shown in FIG. 1, the sidewall 140 is also concave at the base 130. This concavity creates a first, a second, a third, and a fourth concave region 260, 270, 280, 290 extending in a direction parallel to a minor axis of the base 130 (only the first and third concave regions 260, 280 are shown in this view, the second and fourth concave regions 270, 290 are shown in FIG. 5). The first and second concave regions 260, 270 act in the same fashion as the concave channel 250. The concave regions 260, 270 allow air to be circulated underneath the container 100 while the container 100 is in a stacked relationship or on a flat surface. The concave regions 260, 270 extend generally perpendicular to the concave channel 250. This allows for air to be blown across the base 130 of the basket 110 along both the major and minor axes for increased circulation.

Turning now to FIG. 5, all of the four concave regions 260, 270, 280, 290 are shown. The first and second concave regions 260, 270 meet at the concave channel 250. The third and fourth concave regions 280, 290 also meet at the concave channel 250. This configuration allows for a center 300 of the base 130 to be the highest point on the base 130 and to increase the airflow that is circulated under the base 130.

In other embodiments, the concave regions 260, 270, 280, 290 may extend in a direction that is not parallel to the minor axis. The concave regions 260, 270, 280, 290 may extend outwardly at differing angles from the concave channel 250. The orientation of the concave region may depend on the design and intended use of the container 100. Furthermore, in some embodiments, there may be a plurality of concave channels 250 depending on the shape and intended use of the container 100. Also, there may be more or less concave regions depending on the design and intended use of the container 100.

Located at the corners of the base 130 are four vertical contact points 310, 320, 330, 340. The vertical contact points 310, 320, 330, 340 provide support for the container 100 and contact the surface on which the container 100 lies. In this embodiment, two other vertical contact points 350, 360 are also included. These vertical contact points 350, 360 provide further support to the sidewalls 140, 150 to keep the sidewalls 140, 150 from buckling during transport. Also, the location of the vertical contact points 310, 320, 330, 340, 350, 360 defines the initial widths of the concave channel 250 and the concave regions 260, 270, 280, 290. In some embodiments, the container may have more or less vertical contact points. Some containers may have only four vertical contact points (one at each of the four corners), while others may have as many as nine (one at each of the four corners, one between each of the corners and one in the middle). In alternative embodiments, more or less vertical contact points may be included, depending on the size and intended use of the container 100.

The concave channel 250 and the concave regions 260, 270, 280, 290 also provide cushioning for the fruit during transport. As mentioned in the background section, the fruit is often transported by trucks over long distances. In standard containers, when the fruit bounces during transport (e.g., during loading/unloading of the pallet or the truck hitting a bump in the road), the fruit comes into contact with a rigid base. This may cause the fruit to become bruised. In the present invention, however, the concave channel 250 and the concave regions 260, 270, 280, 290 are malleable and can flex when struck by the fruit. Thus, the base 130 acts as a sort of trampoline for the fruit, thus providing cushioning for the fruit. The likelihood of bruising the fruit decreases and causes less loss of fruit.

The base 130 forms a plurality of ventilation apertures 370 disposed in the concave channel 250. The ventilation apertures 370 allow the cool air to flow into the basket 110 and, thus, cool the fruit directly. In this embodiment, the ventilation apertures 370 are generally circular in shape. It is contemplated, however, that the apertures may be other shapes, such as ovals, triangles, squares, or other polygons. The ventilation apertures 370 are disposed generally symmetrically about the major and minor axes. In other embodiments, the apertures 370 may be alternatively configured.

Figure 6:
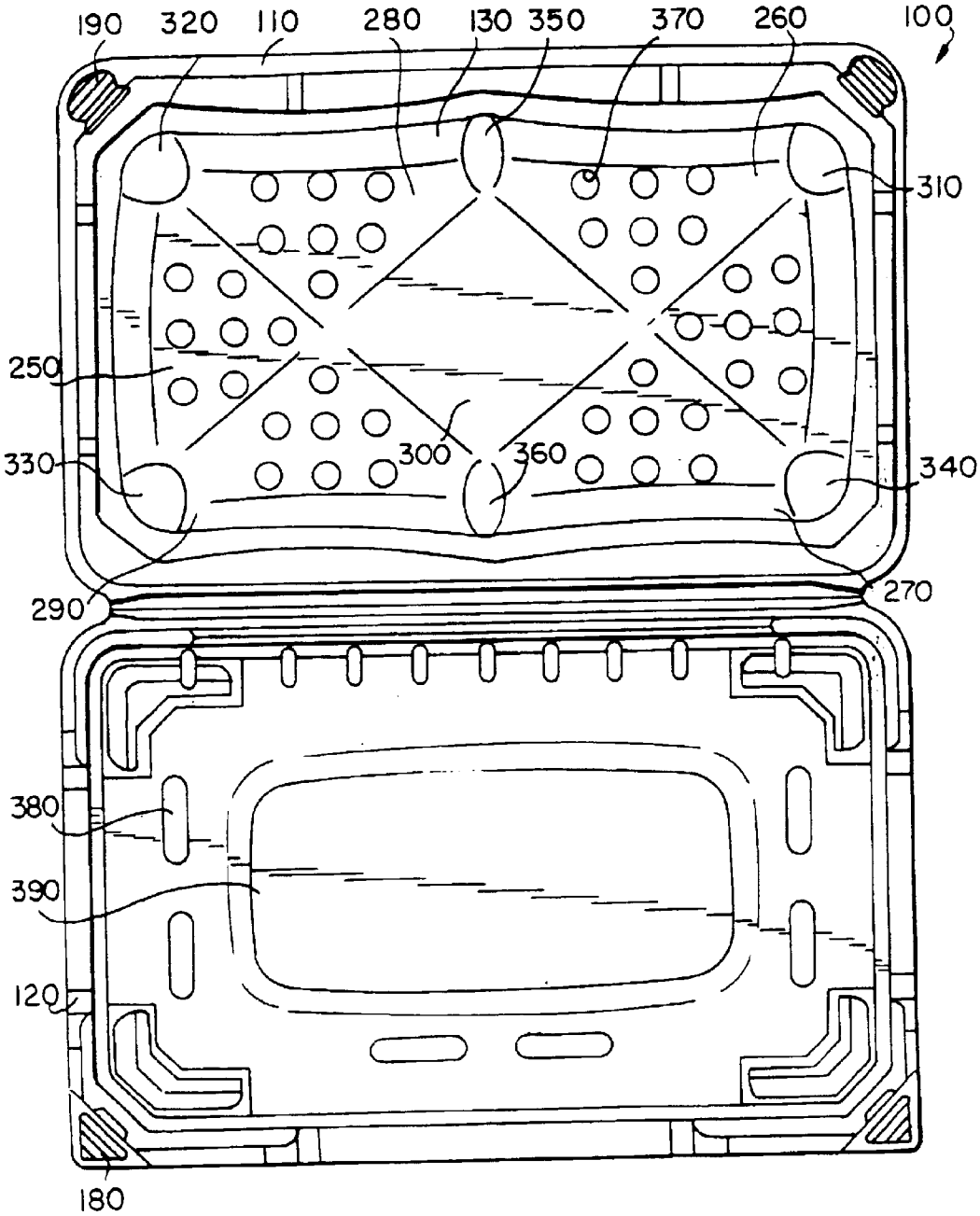
FIG. 6 is a top view of one embodiment of the lid of the container of FIG. 1.

In some embodiments, the lid 120 of the container 100 also defines a plurality of ventilation apertures 380. The ventilation apertures 380 serve to direct airflow into the container 100 to further cool the fruit. In some embodiments, an embossment 390, as illustrated in FIG. 6, is utilized to increase the flow of cool air into the container 100 and a second container when the containers are in a stacked relationship (FIG. 2). Air that is flowing over the top of the lid 120 contacts an edge of the embossment 390 and is directed up toward the second container that is stacked on top of the lid 120. This directed air may flow into the second container through ventilation apertures formed in the base.

As mentioned above, the embossment 390 and the vertical contact points 310, 320, 330, 340, 350, 360 are designed to provide a clearance between the first container 100 and another container 100' when the containers 100, 100' are in a stacked relationship. This clearance allows air to flow between the stacked containers 100, 100' and, thus, more effectively cool the fruit in the containers 100, 100'. FIG. 2 illustrates the vertical clearances between the containers 100, 100' when they are in a stacked relationship.

Figure 7:
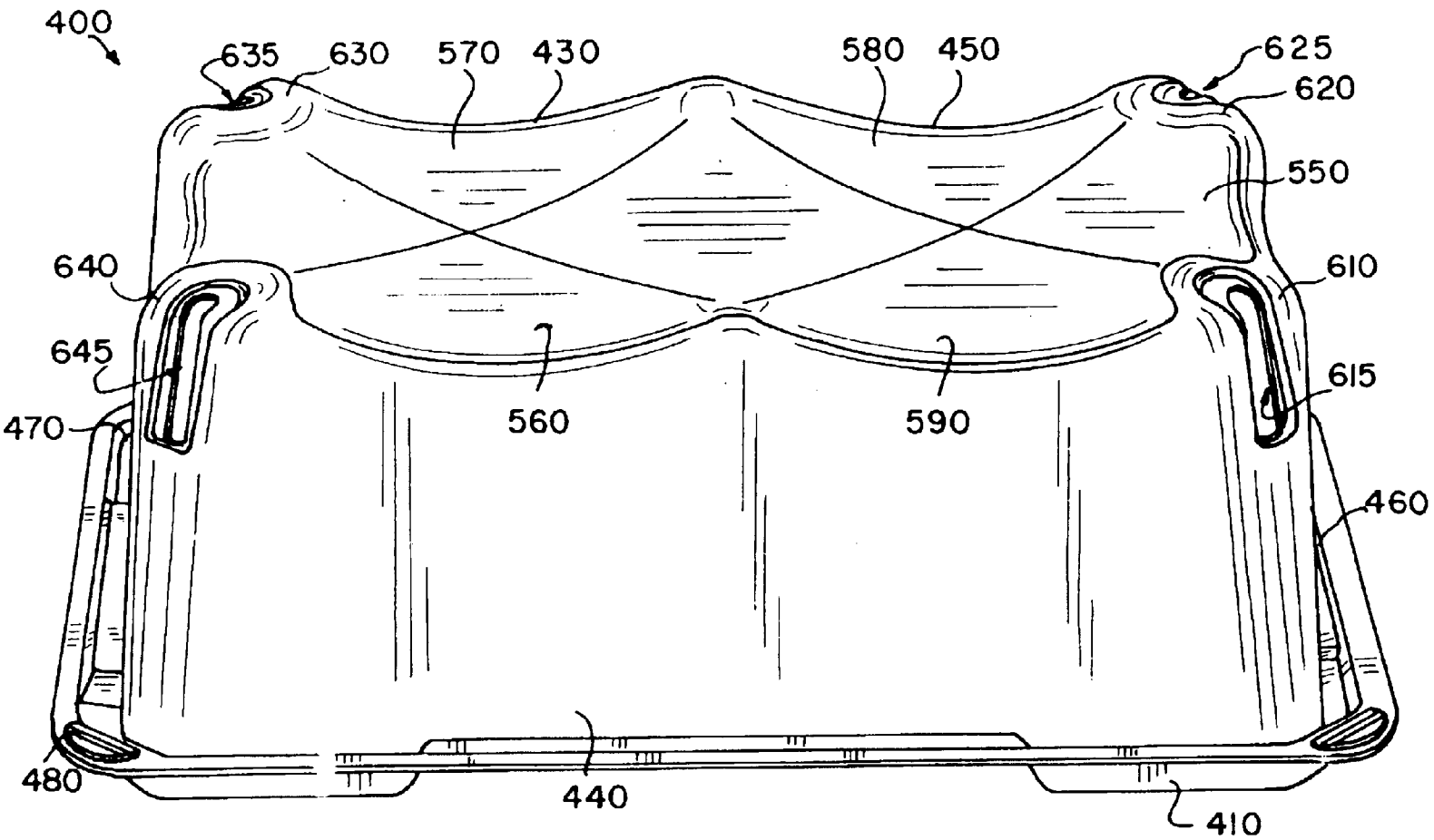
FIG. 7 is a bottom perspective view of one embodiment of a container.
Figure 8:
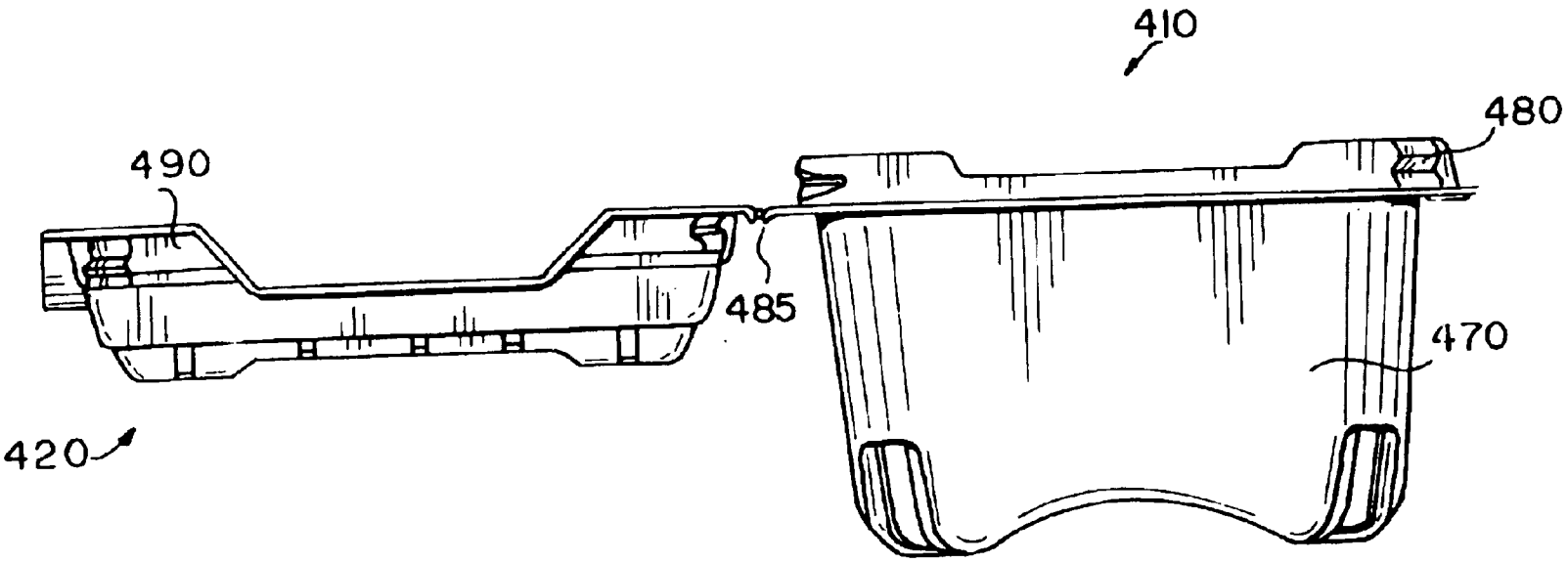
FIG. 8 is an end view of the container of FIG. 7 with the lid in an open position.
Figure 10:
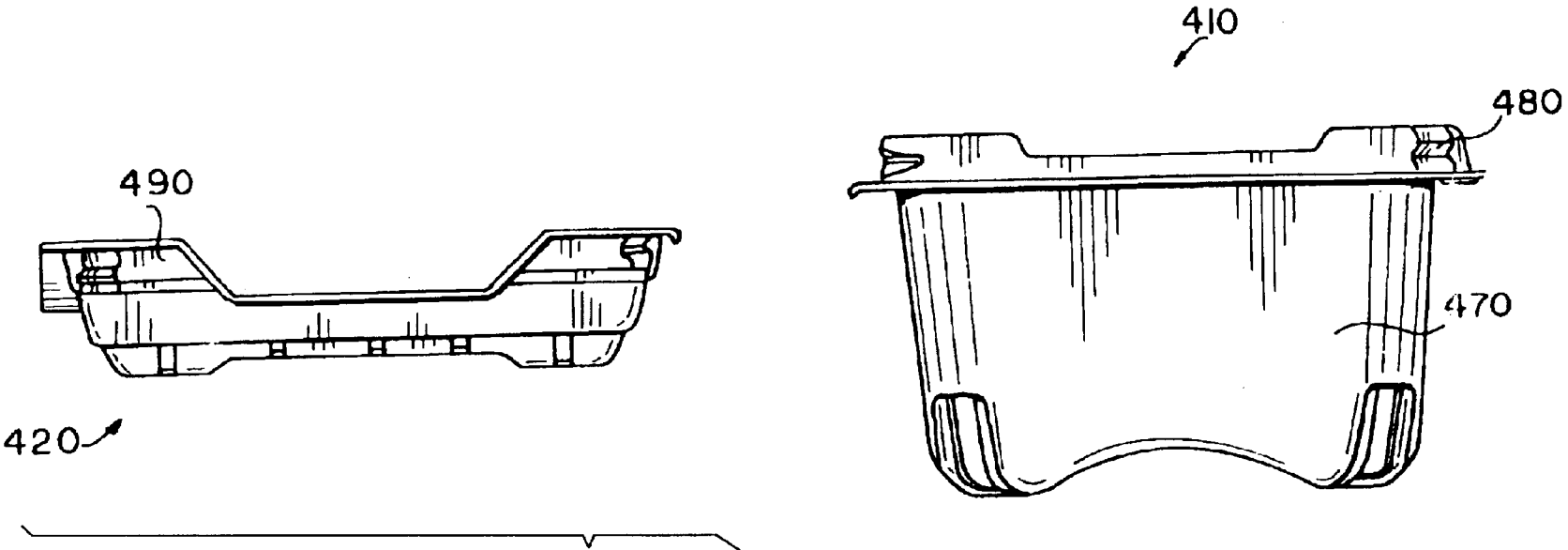
FIG. 10 is an end view of a container similar to the container of FIG. 7 with the lid in an open position.

Turning now to FIG. 7, a bottom perspective view of a container 400 is illustrated according to another embodiment. The container 400 as shown in FIGS. 7 and 8 comprises a basket 410 and a lid 420. The basket 410 includes a base 430, first and second sidewalls 440, 450, first and second endwalls 460, 470, and a first latching portion 480. These components are similar to the base 130, the first and second sidewalls 140, 150, the first and second endwalls 160, 170, and the first latching portion 180, respectively. The sidewalls 440, 450 and the endwalls 460, 470 of FIG. 7 are substantially smooth and substantially free of any ribbing structure. As shown in FIG. 8, the lid 420 includes a second latching portion 490 and is attached to the basket 410 via a hinge 485. It is contemplated that the lid 420 may be a separate structure from the basket 410, as depicted in FIG. 10. It is also contemplated that the lid 420 may be attached to the basket 410 via other hinges known in the art.

Referring back to FIG. 7, the base 430 includes a concave channel 550 that is formed in a direction along a major axis of the base 430. The concave channel 550 may be formed in a direction that is generally parallel or parallel to a major axis of the base 430. The concave channel 550 is similar to that described above with respect to the concave channel 150. It is contemplated that the concave channel may be formed in a diagonal direction with respect to the major axis of the base. The base 430 also includes first, second, third, and fourth concave regions 560, 570, 580, 590. The concave regions 560, 570, 580, 590 are similar to the concave regions 160, 170, 180 and 190 described above. The number of concave regions may vary from that shown in FIG. 7. The sidewalls 440, 450 and endwalls 460, 470 meet at the base 430 and form four vertical contact points 610, 620, 630, 640. It is contemplated that the number of vertical contact points may differ than shown in FIG. 7.

The intersections of respective first and second sidewalls 440, 450 and first and second endwalls 460, 470 form wall ventilation apertures 615, 625, 635, 645. The wall ventilation apertures 615, 625, 635, 645 allow cool air to flow into the basket 410 and provide cooling properties to the fruit within the container. In the illustrated embodiment, the wall ventilation apertures 615, 625, 635, 645 are located near the four vertical contact points 610, 620, 630, 640. In other embodiments, the wall ventilation apertures 615, 625, 635, 645 may be formed in other locations on the intersections of the respective sidewalls 440, 450 and endwalls 460, 470. Additionally, apertures may be formed in the base, sidewalls and/or endwalls. For example, the contact point formed by convex regions 560 and 590 of FIG. 7 may include an aperture formed near this point. Likewise, an aperture point may be formed near the base at a point generally between the ventilation apertures 615 and 645. It is contemplated that additional apertures may be formed near the intersections of the sidewalls and/or endwalls with the base. The wall ventilation apertures 615, 625, 635, 645 of FIG. 7 are shown as being generally oval in shape, but it is contemplated that the apertures may be other shapes, such as circles, triangles, squares, or other polygons. Also, in some embodiments, there may be more than one wall ventilation aperture per each intersection of respective sidewalls and endwalls. For example, the intersection of each respective sidewalls and endwalls may have two wall ventilation apertures. In other embodiments, not every intersection of respective sidewalls and endwalls may have a wall ventilation aperture. For example, in one embodiment, the base may have only one wall ventilation aperture formed by the intersection of one sidewall and one endwall.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container, comprising:

a basket having a base, a pair of sidewalls, and a pair of endwalls, the base, pair of sidewalls, and pair of endwalls being integrally connected, the pair of sidewalls and the pair of endwalls integrally extending outwardly to form a first latching portion, the base forming a concave channel, a first concave region, and a second concave region, the concave channel extending along a major axis of the base, the first concave region extending from the concave channel to one of the pair of sidewalls, and the second concave region extending from the concave channel to the other of the pair of sidewalls, at least one of the sidewall and endwall intersections forming a wall ventilation aperture; and a lid being adapted to connect to the basket, the lid having a second latching portion corresponding to the first latching portion of the base, the first and second latching portions being adapted to retain the lid and the basket in a closed relationship.

2. The container of claim 1, wherein the concave channel, first concave region, and second concave region are adapted to provide airflow along the major axis and a minor axis.

3. The container of claim 1, wherein the pair of endwalls and pair of sidewalls are substantially smooth and substantially free of any ribbing structure.

4. The container of claim 1, wherein the lid is hingedly connected to the basket.

5. The container of claim 1, wherein the lid and the basket are two separate pieces.

6. The container of claim 1, wherein the base comprises a first vertical contact point, a second vertical contact point, a third vertical contact point, a fourth vertical contact point, a fifth vertical contact point, and a sixth vertical contact point, the first, second, third, and fourth vertical contact points being located near each of four corners thereof, the fifth vertical contact point being disposed along one of the pair of sidewalls, between the first and fourth vertical contact points, and the sixth vertical contact point being disposed along the other of the pair of sidewalls between the second and third vertical contact points.

7. The container of claim 1, wherein the base comprises a first vertical contact point, a second vertical contact point, a third vertical contact point, a fourth vertical contact point, a fifth vertical contact point, a sixth vertical contact point, a seventh vertical contact point, an eighth vertical contact point, and a ninth vertical contact point, the first, second, third, and fourth vertical contact points being located near each of four corners thereof, the fifth vertical contact point being disposed along the bottom of one of the pair of sidewalls and approximately midway between the first and second vertical contact points, the sixth vertical contact point being disposed along the bottom of one of the pair of endwalls and approximately midway between the second and third vertical contact points, the seventh vertical contact point being disposed along the bottom of the other of the pair of sidewalls and approximately midway between the third and fourth vertical contact points, the eighth vertical contact point being disposed along the bottom of the other of the pair of endwalls and approximately midway between the first and fourth vertical contact points, and the ninth vertical contact point being disposed in approximately the center of the base.

8. The container of claim 1, wherein the intersections of respective endwalls and sidewalls form at least four curved corners.

9. The container of claim 1, wherein the lid is constructed to stackably engage a base of a second container.

10. The container of claim 1, wherein the base further forms a plurality of ventilation apertures, the plurality of ventilation apertures being generally symmetrically disposed along at least one of the major axis and the minor axis of the base.

11. The container of claim 1, wherein at least one of the concave channel, first concave region, and second concave region varies in width along its length.

12. The container of claim 1, wherein the concave channel extends generally parallel to a major axis of the base.

13. The container of claim 1, wherein the base further forms at least one ventilation aperture adapted to increase airflow through the basket.

14. The container of claim 13, wherein the at least one ventilation aperture is disposed in one of the concave channel, first concave region, and second concave region.

15. The container of claim 1, wherein the base further forms a third concave region, the third concave region extending from the concave channel to one of the pair of sidewalls, the third concave region being adjacent to the first concave region.

16. The container of claim 15, wherein the base further forms a fourth concave region, the fourth concave region extending from the concave channel to the other of the pair of sidewalls, the fourth concave region being adjacent to the second concave region.

17. The container of claim 1, wherein the lid comprises an embossment.

18. The container of claim 17, wherein the lid forms a plurality of ventilation apertures adjacent to the embossment.

19. The container of claim 17, wherein the embossment forms a plurality of ventilation apertures.

20. The container of claim 1, wherein the base comprises a respective vertical contact point near each of four corners thereof, the vertical contact points being adapted to nestably engage a lid of a second container when the second container is in a stacked relationship with the container.

21. The container of claim 20, wherein at least one of the vertical contact points forms the at least one of the wall ventilation aperture.

22. The container of claim 21, wherein each of the vertical contact points forms a respective one of the at least one wall ventilation aperture.

23. The container of claim 21, wherein each of the vertical contact points forms at least two wall ventilation apertures.

24. The container of claim 1, wherein the first latching portion and the second latching portion define a first ventilation slot when the first and second latching portions are in a closed relationship with each other.

25. The container of claim 24, wherein the lid further comprises a rim, the rim extending at least partially around the lid and forming a plurality of ventilation apertures.

26. The container of claim 24, wherein the first latching portion and the second latching portion further define a second ventilation slot opposite the first ventilation slot when the first and second latching portions are in a closed relationship with each other.

27. The container of claim 24, wherein the first latching portion defines a plurality of ventilation apertures opposite to and in alignment with the first ventilation slot when the first and second latching portions are in a closed relationship with each other.

28. The container of claim 24, wherein the first latching portion and the second latching portion further define a pair of second ventilation slots when the first and second latching portions are in a closed relationship with each other, the pair of second ventilation slots being located opposite of each other, the first ventilation slot and each of the pair of second ventilation slots being located on a different one of the pair of sidewalls and endwalls.

29. A hinged container, comprising:

a basket having a base, a pair of generally smooth and flat sidewalls, and a pair of generally smooth and flat endwalls, the base, pair of sidewalls, and pair of endwalls being integrally connected, the pair of sidewalls and the pair of endwalls integrally extending outwardly to form a first latching portion, the base forming a concave channel, a first concave region, and a second concave region, the concave channel extending generally parallel to a major axis of the base, the first concave region extending from the concave channel to one of the pair of sidewalls, and the second concave region extending from the concave channel to the other of the pair of sidewalls, the base forming a vertical contact point near each of four corners of the base, each of the vertical contact points forming a ventilation aperture and being adapted to nestably engage a lid of a second container when the second container is in a stacked relationship with the container, and a lid being hingedly connected to the first latching portion, the lid having a second latching portion corresponding to the first latching portion, the first and second latching portions being adapted to retain the lid and the basket in a closed relationship, the first and second latching portions defining a first ventilation slot, a second ventilation slot opposite of the first ventilation slot, and a pair of third opposing ventilation slots when the first and second latching portions are in a closed relationship with each other, the lid forming a plurality of ventilation apertures.

30. A hinged container, comprising:

a basket having a base, a pair of generally smooth sidewalls, and a pair of generally smooth endwalls, the base, pair of sidewalls, and pair of endwalls being integrally connected, the pair of sidewalls and the pair of endwalls integrally extending outwardly to form a first latching portion, the base forming a concave channel, a first concave region, and a second concave region, the concave channel extending generally along a major axis of the base, the first concave region extending from the concave channel to one of the pair of sidewalls, and the second concave region extending from the concave channel to the other of the pair of sidewalls, at least one of the sidewall and endwall intersections forming a wall ventilation aperture; and a lid being hingedly connected to the first latching portion, the lid having a second latching portion corresponding to the first latching portion, the first and second latching portions being adapted to retain the lid and the basket in a closed relationship, the first and second latching portions defining a first ventilation slot, a plurality of ventilation apertures opposite of the first ventilation slot, and a pair of third ventilation slots opposite of each other when the first and second latching portions are in a closed relationship relative to each other, the first ventilation slot and the pair of third ventilation slots being located on a different one of the pair of sidewalls and endwalls.

31. A hinged container, comprising:

a basket having abase, a pair of sidewalls, and a pair of endwalls, the base, pair of sidewalls, and pair of endwalls being integrally connected, the pair of sidewalls and the pair of endwalls integrally extending outwardly to form a first latching portion, the base forming a cushioning region that is adapted to flex when a force is applied thereto, at least one of the sidewall and endwall intersections forming a wall ventilation aperture, wherein the cushioning region comprises a concave channel extending generally parallel to a major axis of the base, a first concave region extending from the concave channel to one of the pair of the sidewalls, and a second concave region extending from the concave channel to the other of the pair of sidewalls; and a lid being hingedly connected to the first latching portion, the lid having a second latching portion corresponding to the first latching portion, the first and second latching portions being adapted to retain the lid and the basket in a closed relationship.

32. A hinged container, comprising:

a basket having a base, a pair of sidewalls, and a pair of endwalls, the base, pair of sidewalls, and pair of endwalls being integrally connected, the pair of sidewalls and the pair of endwalls integrally extending outwardly to form a first latching portion, at least one of the sidewall and endwall intersections forming a wall ventilation aperture; and a lid being hingedly connected to the first latching portion, the lid having a second latching portion corresponding to the first latching portion, the first and second latching portions being adapted to retain the lid and the basket in a closed relationship, the first and second latching portions defining a first ventilation slot and a second ventilation slot opposite the first ventilation slot when the first and second latching portions are in a closed relationship with each other, the first and second ventilation slots extending parallel to a major axis of the container.

33. The container of claim 32, wherein the pair of endwalls and pair of sidewalls are substantially smooth and substantially free of any ribbing structure.

34. The container of claim 32, wherein the lid further comprises a rim, the rim extending at least partially around the lid and forming a plurality of ventilation apertures.

35. The container of claim 32, wherein the first latching portion and the second latching portion further define a pair of third ventilation slots when the first and second latching portions are in a closed relationship with each other, the pair of third ventilation slots being located opposite of each other, the first ventilation slot, the second ventilation slot and each of the pair of third ventilation slots being located on a different one of the pair of sidewalls and endwalls.

36. The container of claim 32, wherein the base comprises a respective vertical contact point near each of four corners thereof, the vertical contact points being adapted to nestably engage a lid of a second container when the second container is in a stacked relationship with the container, each of the vertical contact points forming a respective one of at least one wall ventilation aperture.

37. The container of claim 32, wherein the base comprises a first vertical contact point, a second vertical contact point, a third vertical contact point, a fourth vertical contact point, a fifth vertical contact point, and a sixth vertical contact point, the first, second, third, and fourth vertical contact points being located near each of four corners thereof, the fifth vertical contact point being disposed along one of the pair of sidewalls, between the first and fourth vertical contact points, and the sixth vertical contact point being disposed along the other of the pair of sidewalls between the second and third vertical contact points.

38. The container of claim 32, wherein the intersections of respective endwalls and sidewalls form at least four curved corners.

39. The container of claim 32, wherein the base further forms at least one ventilation aperture adapted to increase airflow through the basket.

40. The container of claim 39, wherein the at least one ventilation aperture is disposed in one of the concave channel, first concave region, and second concave region.

41. The container of claim 32, wherein the lid comprises an embossment.

42. The container of claim 41, wherein the lid forms a plurality of ventilation apertures adjacent to the embossment.

43. The container of claim 41, wherein the embossment forms a plurality of ventilation apertures.

44. The container of claim 32, wherein the base forms a concave channel extending generally parallel to a major axis of the base.

45. The container of claim 44, wherein the base further forms:

a first concave region extending from the concave channel to one of the pair of sidewalls;

a second concave region extending from the concave channel to the other of the pair of sidewalls;

a third concave region, the third concave region extending from the concave channel to one of the pair of sidewalls, the third concave region being adjacent to the first concave region; and a fourth concave region, the fourth concave region extending from the concave channel to the other of the pair of sidewalls, the fourth concave region being adjacent to the second concave region.

46. The container of claim 45, wherein at least one of the concave channel, first concave region, second concave region, third concave region, and fourth concave region varies in width along its length.

47. A container, comprising:

a basket having a base, a pair of sidewalls, and a pair of endwalls, the base, pair of sidewalls, and pair of endwalls being integrally connected, the pair of sidewalls and the pair of endwalls integrally extending outwardly to form a first latching portion, the base forming a concave channel, a first concave region, and a second concave region, the concave channel extending along a major axis of the base, the first concave region extending from the concave channel to one of the pair of sidewalls, and the second concave region extending from the concave channel to the other of the pair of sidewalls; and a lid being adapted to connect to the basket, the lid having a second latching portion corresponding to the first latching portion of the base, the first and second latching portions being adapted to retain the lid and the basket in a closed relationship.

48. The container of claim 47, wherein the concave channel, first concave region, and second concave region are adapted to provide airflow along the major axis and a minor axis.

49. The container of claim 47, wherein the pair of endwalls and pair of sidewalls are substantially smooth and substantially free of any ribbing structure.

50. The container of claim 47, wherein the lid forms a plurality of ventilation apertures adjacent to the embossment.

51. The container of claim 47, wherein the lid is hingedly connected to the basket.

52. The container of claim 47, wherein the lid and the basket are two separate pieces.

53. The container of claim 47, wherein the base further forms at least one ventilation aperture adapted to increase airflow through the basket.

54. The container of claim 47, wherein the concave channel extends generally parallel to a major axis of the base.

55. The container of claim 54, wherein the concave channel extends parallel to a major axis of the base.

56. The container of claim 47, wherein the first latching portion and the second latching portion define a first ventilation slot when the first and second latching portions are in a closed relationship with each other.

57. The container of claim 56, wherein the first latching portion and the second latching portion further define a second ventilation slot opposite the first ventilation slot when the first and second latching portions are in a closed relationship with each other.

58. The container of claim 56, wherein the first latching portion defines a plurality of ventilation apertures opposite to and in alignment with the first ventilation slot when the first and second latching portions are in a closed relationship with each other.

59. The container of claim 56, wherein the first latching portion and the second latching portion further define a pair of second ventilation slots when the first and second latching portions are in a closed relationship with each other, the pair of second ventilation slots being located opposite of each other, the first ventilation slot and each of the pair of ventilation slots being located on a different one of the pair of sidewalls and endwalls.

* * * * *